US007125831B2

(12) United States Patent
Azuma et al.

(10) Patent No.: US 7,125,831 B2
(45) Date of Patent: Oct. 24, 2006

(54) DETERGENT COMPOSITION FOR DRY CLEANING COMPRISING A CYCLIC POLYSILOXANE AND A POLYETHER MODIFIED SILICONE

(75) Inventors: Takaya Azuma, Tokyo (JP); Susumu Shirouzu, Hyogo (JP)

(73) Assignee: NOF Corporation, Tokyo (JP)

( * ) Notice: Subject to any disclaimer, the term of this patent is extended or adjusted under 35 U.S.C. 154(b) by 41 days.

(21) Appl. No.: 10/476,793

(22) PCT Filed: May 29, 2002

(86) PCT No.: PCT/JP02/05203

§ 371 (c)(1),
(2), (4) Date: Nov. 6, 2003

(87) PCT Pub. No.: WO02/097024

PCT Pub. Date: Dec. 5, 2002

(65) Prior Publication Data

US 2004/0142838 A1 Jul. 22, 2004

(30) Foreign Application Priority Data

May 30, 2001 (JP) ..... 2001-163411

(51) Int. Cl.
*C11D 1/83* (2006.01)
*C11D 1/835* (2006.01)
*C11D 3/44* (2006.01)

(52) U.S. Cl. ..... 510/285; 510/282; 510/289; 510/290; 510/304; 510/329; 510/338; 510/340; 510/350; 510/351; 510/356; 510/371; 510/407; 510/421; 510/422; 510/426; 510/427; 510/432; 510/466; 510/504

(58) Field of Classification Search ..... 510/285, 510/282, 289, 290, 304, 329, 338, 340, 350, 510/351, 356, 371, 407, 421, 422, 426, 427, 510/432, 466, 504
See application file for complete search history.

(56) References Cited

U.S. PATENT DOCUMENTS

| | | | | |
|---|---|---|---|---|
| 5,015,469 | A * | 5/1991 | Yoneyama et al. | 424/59 |
| 5,036,108 | A * | 7/1991 | Asahi et al. | 514/772 |
| 6,080,430 | A * | 6/2000 | Ogawa et al. | 424/490 |
| 6,121,373 | A * | 9/2000 | Starch | 524/837 |
| 6,306,409 | B1 * | 10/2001 | Ogawa et al. | 424/401 |
| 6,310,029 | B1 * | 10/2001 | Kilgour et al. | 510/466 |
| 6,428,795 | B1 * | 8/2002 | Miura et al. | 424/401 |
| 6,652,766 | B1 * | 11/2003 | Frankenbach et al. | 252/8.91 |
| 6,660,281 | B1 * | 12/2003 | Nakanishi et al. | 424/401 |
| 6,670,317 | B1 * | 12/2003 | Severns et al. | 510/285 |
| 6,673,118 | B1 * | 1/2004 | DuVal et al. | 8/115.51 |

FOREIGN PATENT DOCUMENTS

| | | |
|---|---|---|
| EP | 0182583 | 5/1986 |
| EP | 1041189 | 10/2000 |
| EP | 1043443 | 10/2000 |
| JP | 11092784 | 4/1999 |
| JP | 200149294 | 2/2001 |

* cited by examiner

*Primary Examiner*—Charles Boyer
(74) *Attorney, Agent, or Firm*—Antonelli, Terry, Stout and Kraus, LLP.

(57) ABSTRACT

The invention can provide a detergent composition for dry cleaning which comprises a nonionic surfactant as the component (a), a cyclic polysiloxane as the component (b) and a polyether modified silicone having a HLB value of at most 6 as the component (c), wherein the content of the component (a) is 5 to 70% by weight based on the total weight of the components (a), (b) and (c), the content of the total of the components (b) and (c) is 30 to 95% by weight based on the same, and the ratio by weight of the component (b) to the component (c) {b/c} is 1/10 to 20/1 and a detergent liquid for dry cleaning using the above detergent composition. The detergent composition and detergent liquid are excellent in detergency, capability of preventing recontamination and solubilizing power in water, which is less prone to cause annular stain on clothes even when a pretreatment agent is used, which imparts favorable flexibility and conformability to an object to be cleaned and which has favorable stability with the lapse of time.

10 Claims, No Drawings

DETERGENT COMPOSITION FOR DRY CLEANING COMPRISING A CYCLIC POLYSILOXANE AND A POLYETHER MODIFIED SILICONE

TECHNICAL FIELD

The present invention relates to a detergent composition for dry cleaning which is excellent in detergency, capability of preventing recontamination and solubilizing power in water, which is less prone to cause annular stain on clothes even when a pretreatment agent is used, which imparts favorable softness and conformability to an object to be cleaned and which has favorable stability with the lapse of time; and to a detergent liquid for dry cleaning using the aforesaid detergent composition.

BACKGROUND ART

In general, for the cleaning of clothes, there are available wet cleaning in which cleaning is carried out with a neutral detergent using water as the medium, laundry cleaning in which cleaning is carried out with an alkaline detergent using water as the medium and dry cleaning in which an organic solvent is used as the medium. Clothes made of wool fabric such as suits and sweater, when cleaned by a method using water as the medium, are likely to shrink and/or lose original trim appearance. In addition, clothes made of silk fabric such as necktie and scarf, when cleaned by a method using water as the medium, are likely to lose surface gloss. For the reasons mentioned above in the majority of instances, clothes made of any of wool fabric and silk fabric are cleaned by means of dry cleaning which is less prone to cause a problem of shrinkage and the like.

There are available as an organic solvent to be used in dry cleaning, halogen base solvents such as tetrachloroethylene; 1,1,2-trichloro-1,2,2-trifluoroethane; 1,1,1-trichloroethane, and alternative solvents to flon (chlorofluorocarbon) exemplified by 1,3-dichloro-1,2,2,3,3-pentafluoropropane, 1,1-dichloro-1-monofluoroethane and the like in addition to a petroleum base solvent. In recent years however, there have been pointed out a variety of problems on the above-mentioned solvents from the viewpoint of influences on global environment and the ecosystem. That is to say, a petroleum base solvent, which is a substance responsible for air pollution, involves such a problem as dermal injury due to the residence thereof in the case of insufficiently dried clothes. Moreover, carcinogenicity of tetrachloroethylene is pointed out, whereby curtailment of an amount thereof to be used is required. Further, it has been decided since 1996 to entirely abolish the production of 1,1,2-trichloro-1,2,2-trifluoroethane and 1,1,1-trichloroethane each as an ozonosphere-depleting substance. Furthermore, it is decided to entirely abolish in 2020, the production of 1,3-dichloro-1,2,2,3,3-pentafluoropropane because of its concern for being a prospective ozonosphere-depleting substance.

On the other hand, accompanying improved standard of living in recent years, high grade-oriented clothes are enhanced, resulting in advanced diversification thereof. As a consequence, conventional dry cleaning system elutes the dyeing of clothes and/or impairs decorations such as buttons as the case may be. For the reasons mentioned above, attention has been paid to a silicone base solvent as a solvent for dry cleaning which never impairs diversified clothes and exerts less influence on the global environment and the ecosystem.

However a silicone base solvent, when used alone for cleaning, is not sufficient in detergency for dirt due to oil and fat and water-soluble dirt, and brings about the likelihood that the dirt once removed from clothes again sticks thereto. In addition, the silicone base solvent is inferior in detergency for water-soluble dirt such as sweat stain and spot stuck to trousers, skirts, collars of suits and the like. Even when there is used a pretreatment agent in which a surfactant is blended with water and an alcohol for the purpose of removing sweat stain and spot prior to dry cleaning, the silicone base solvent is prone to give rise to such a clothes trouble as annular stain on clothes owing to lack of its sufficient solubilizing power in water and at the same time, to impair softness and conformability of clothes after cleaning.

Such being the case, there is eagerly desired the development of a detergent composition which is used for dry cleaning and which brings about excellent properties in detergency, capability of preventing recontamination, solubilizing power in water and softness and conformability of clothes after cleaning by being added to a silicone base solvent.

There are disclosed a composition which is blended with a polyether modified silicone having a molecular weight of at most 3500 and a nonionic surfactant in Japanese Patent Application Laid-Open No. 59395/1993 (Hei 5); a composition which is blended with a cyclic polysiloxane and a nonionic surfactant of polyoxyalkylene series having a HLB value in the range of 2 to 10 in Japanese Patent Application Laid-Open No. 13095/1997 (Hei 9); and a composition which is blended with a cyclic polysiloxane, a surfactant and a hydrophilic solvent in Japanese Patent Application Laid-Open No. 176697/1997 (Hei 9). Nevertheless in the case where dry cleaning is carried out by adding any of the above-mentioned compositions in a silicone base solvent, a problem still remains unsolved in that capability of preventing recontamination and solubilizing power in water are insufficient, thus causing deterioration in softness and conformability of clothes and clothes trouble of annular stain after cleaning.

DISCLOSURE OF THE INVENTION

An object of the present invention is to provide under such circumstances, a detergent composition for dry cleaning which is excellent in detergency, capability of preventing recontamination and solubilizing power in water, which is less prone to cause annular stain on clothes even when a pretreatment agent is used, which imparts softness and conformability to an object to be cleaned and which has favorable stability with the lapse of time; and a detergent liquid for dry cleaning using the aforesaid composition. That is to say, the present invention pertains to the following.

1. a detergent composition for dry cleaning which comprises a nonionic surfactant as the component (a), a cyclic polysiloxane represented by the general formula (1) as the component (b) and a polyether modified silicone having a HLB value of at most 6 and represented by the general formula (2) as the component (c), wherein the content of the component (a) is 5 to 70% by weight based on the total weight of the components (a), (b) and (c), the content of the total of the components (b) and (c) is 30 to 95% by weight based on the same, and the ratio by weight of the component (b) to the component (c) {b/c} is 1/10 to 20/1:

(1)

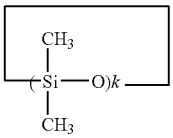

wherein k is a number from 3 to 6, (2)

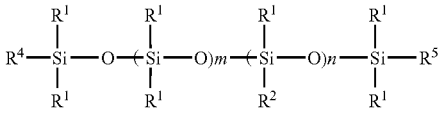

wherein $R^1$ is an alkyl group having 1 to 5 carbon atoms or a phenyl group; $R^2$ is —(CH²)p—O—($C_2H_4O$)q($C_3H_6O$)r—$R^3$ ($R^3$ is hydrogen atom or an alkyl group having 1 to 5 carbon atoms, p is a number from 1 to 5, q and r are each the average number of addition moles, q is a number from 0 to 50, r is a number from 0 to 30 with the proviso that $1 \leqq q+r<60$); m and n are each an average degree of polymerization, m is a number from 1 to 300, n is a number from 0 to 50; $R^4$ and $R^5$ are each an alkyl group having 1 to 5 carbon atoms or a phenyl group or $R^2$, and may be the same as or different from each other with the proviso that when n is equal to 0, at least one of $R^4$ and $R^5$ is $R^2$.

2. A detergent liquid for dry cleaning which comprises the detergent composition for dry cleaning as set forth in the preceding item (1) and a halogen base solvent or a petroleum base solvent or a silicone base solvent in an amount of 5 to 1000 times by volume that of said composition.
3. A cleaning method wherein use is made of the detergent liquid for dry cleaning as set forth in the preceding item (2).

THE MOST PREFERRED EMBODIMENT TO CARRY OUT THE INVENTION

In the following, the present invention will be described in more detail.

Examples of the nonionic surfactant as the component (a) include for instance, polyoxyalkylene alkyl ether, polyoxyalkylene alkenyl ether, polyoxyalkylene fatty acid ester, polyoxyalkylene alkylphenol ether, sugar ester, polyoxyalkylene sugar ester, sorbitan fatty acid ester, polyoxyalkylene sorbitan fatty acid ester, fatty acid alkanolamide or adduct thereof with alkylene oxide, monoglycerol-fatty acid ester, polyglycerol-fatty acid ester, polyoxyalkylene hydrogenated castor oil and alkyl glycoside.

Preferably usable nonionic surfactant among them from the viewpoint of assuring high solubilizing power in water is at least one species selected from the group consisting of polyoxyalkylene alkyl ether, polyoxyalkylene alkenyl ether, polyoxyalkylene fatty acid ester, polyoxyalkylene alkylphenol ether, sorbitan fatty acid ester, polyoxyalkylene sorbitan fatty acid ester, fatty acid alkanolamide and an adduct of fatty acid alkanolamide with alkylene oxide, of which sorbitan fatty acid ester is preferable in particular. Preferable fatty acids that are used for the sorbitan fatty acid ester are stearic acid and oleic acid.

In the detergent composition according to the present invention, the blending amount of the component (a) is 5 to 70% by weight, preferably 10 to 50% by weight based on the total weight of the components (a), (b) and (c). The blending amount thereof, when being less than 5% by weight based thereon, brings about deterioration in detergency, capability of preventing recontamination and solubilizing power in water, whereas the amount thereof, when being more than 70% by weight based thereon, gives rise to deterioration in stability with the lapse of time.

With regard to the cyclic polysiloxane as the component (b) represented by the general formula (1) in the present invention, k indicates the degree of polymerization of siloxane and is in the range of 3 to 6. Such compounds are exemplified by hexamethylcyclotrisiloxane, octamethylcyclotetrasiloxane, decamethylcyclopentasiloxane, dodecamethylcyclohexasiloxane and the like. Of these, octamethylcyclotetrasiloxane and decamethylcyclopentasiloxane each having the k value of 4 to 5 are preferable from the standpoint of handling.

With regard to the polyether modified silicone as the component (c) represented by the general formula (2) in the present invention, $R^1$ is an alkyl group having 1 to 5 carbon atoms or phenyl group, wherein the alkyl group may be any of straight chain and branched chain, and is exemplified by methyl group, ethyl group, propyl group, isopropyl group, butyl group, isobutyl group, pentyl group, isopentyl group and the like. The alkyl group $R^1$ having 6 or more carbon atoms causes a fear of difficult availability and economic disadvantage for the above-mentioned silicone. $R^2$ is —($CH_2$)p—O—($C_2H_4O$)q ($C_3H_6O$)r—$R^3$ in which p is a number from 1 to 5, and p exceeding 5 causes a fear of difficult availability and economic disadvantage for the silicone; q is an average number of addition moles of oxyethylene group and is in the range of 0 to 50, r is an average number of addition moles of oxypropylene group and is in the range of 0 to 30, the total of q and r is at least 1 and less than 60, and when q, r or the total of q and r exceeds 50, 30 or 60, respectively, there is brought about a fear of unreasonably high viscosity and difficult handling for the silicone. $R^3$ is hydrogen atom or an alkyl group having 1 to 5 carbon atoms, wherein the alkyl group may be any of straight chain and branched chain, and is exemplified by methyl group, ethyl group, propyl group, isopropyl group, butyl group, isobutyl group, pentyl group, isopentyl group and the like. The alkyl group $R^3$ having more than 5 carbon atoms causes a fear of difficult availability and economic disadvantage for the silicone. The symbols m and n are each an average degree of polymerization, m is a number from 1 to 300, n is a number from 0 to 50, and when m or n exceeds 300 or 50, respectively, there is brought about a fear of unreasonably high viscosity and difficult handling for the silicone. $R^4$ and $R^5$ are each an alkyl group having 1 to 5 carbon atoms or phenyl group or $R^2$, and may be the same as or different from each other with the proviso that when n is equal to 0, at least one of $R^4$ and $R^5$ is $R^2$. Examples of $R^4$ and $R^5$ each being an alkyl group include those in the above-mentioned $R^1$ and $R^3$. The alkyl group $R^4$ or $R^5$ each having more than 5 carbon atoms causes a fear of difficult availability and economic disadvantage for the silicone.

It is preferable in the silicone compound from the aspect of softness and conformability to be imparted to clothes that $R^1$, $R^4$ and $R^5$ are each methyl group, p is 3 and the total of q and r is 1 to 10 in $R^2$, $R^3$ is hydrogen atom or butyl group, m is 1 to 30 and n is 1 to 5 or that $R^1$ is methyl group, p is 3 and the total of q and r is 1 to 20 in $R^2$, $R^3$ is hydrogen atom, $R^4$ and $R^5$ are each $R^2$, m is 1 to 80 and n is 0. In addition, the component (c) has a HLB value of preferably at most 6, more preferably at most 4. The HLB value of more than 6 gives rise to deterioration in stability with the lapse of time.

The HLB value as mentioned herein is the value determined from the following formula by the use of haze number A:

$$HLB \text{ value}=0.89\times\text{haze number } A+1.11$$

wherein the haze number A is an amount of 2% aqueous solution of phenol in milliliter which is required when polyether modified silicone is dissolved in 5 milliliter of ethanol, and is titrated with 2% aqueous solution of phenol, while the solution of the silicone is kept at 25° C.

The polyether modified silicone as the component (c) is obtainable in accordance with a publicly well known method, for instance, the method described in Japanese Patent Application Laid-Open No. 22712/1981 (Sho 56) by reacting under heating, organohydrogen polysiloxane and polyoxyalkylene monoallyl ether in the presence of a platinum catalyst.

In regard to the detergent composition according to the present invention, the total amount of the components (b) and (c) {b+c} is 30 to 95% by weight based on the total weight of the components (a), (b) and (c), preferably 50 to 90% by weight based thereon. The total amount {b+c}, when being less than 30% by weight based thereon, gives rise to deterioration in stability with the lapse of time, whereas the {b+c}, when being more than 95% by weight, brings about deterioration in detergency, capability of preventing recontamination and solubilizing power in water. Moreover, the ratio by weight of the component (b) to the component (c) {b/c} is 1/10 to 20/1, preferably 1/5 to 10/1. The ratio {b/c}, when being less than 1/10, namely a small content of the component (b), leads to deterioration in softness and conformability due to stickiness of clothes, whereas the ratio {b/c}, when being more than 20/1, namely a large content of the component (b), gives rise to deterioration in stability with the lapse of time.

It is preferable that the total amount of the components (a), (b) and (c) in the detergent composition according to the present invention is at least 10% by weight. When the total amount thereof is less than 10% by weight, there is caused deterioration in detergency, capability of preventing recontamination and solubilizing power in water as the case may be.

The detergent composition for dry cleaning according to the present invention may be incorporated with a surfactant other than the foregoing to the extent that the working effect of the present invention is not impaired thereby. Such surfactant is exemplified by quaternary ammonium salts such as monoalkyldimethyl ammonium salt and alkylimidazolium; anionic surfactant such as alkylphosphoric ester, alkylbenzene sulfonate and dialkyl sulfosuccinate; ampholytic surfactant such as alkyl betaine, amido betaine, imidazolinium betaine and sulfo betaine.

In particular for the purpose of enhancing softness and conformability, it is preferable to use an alkyl imidazoline type cationic surfactant and/or an alkyldimethylhydroxyethyl ammonium salt type cationic surfactant. Any of the above-mentioned surfactants is contained in the detergent composition according to the present in an amount of preferably 0.1 to 15% by weight, particularly 3 to 10% by weight. In addition for the purpose of enhancing solubilizing power in water, it is preferable to use an alkylphophoric ester type anionic surfactant and/or an alkylbenzene sulfonate type anionic surfactant. Any of the the surfactants just mentioned is contained in the detergent composition according to the present in an amount of preferably 0.1 to 15% by weight, particularly 3 to 10% by weight.

The detergent composition for dry cleaning according to the present invention may be incorporated with an additive which is generally added to a detergent component for dry cleaning and which is exemplified by a lower alcohol such as methyl alcohol, ethyl alcohol and 3-methyl-3-methoxybutanol; polyhydric alcohol such as glycerol, diethylene glycol and dipropylene glycol; an antimicrobial agent such as triclosan; a chelating agent, a metal corrosion inhibitor such as benzotriazole; a fluorescent brightening agent and the like.

The detergent composition for dry cleaning according to the present invention can be put into service as a detergent liquid for dry cleaning by adding to the composition and diluting the same with 5 to 1000 times by volume of an organic solvent such as a halogen base solvent, petroleum base solvent and silicone base solvent. The use of a silicone base solvent is preferable in the present invention from the viewpoint of less influences on global environment and the ecosystem.

Examples of the silicone base solvent to be used for diluting the detergent composition include polydimethylsiloxane such as octamethyltrisiloxane and decamethyltetrasiloxane, methylphenylpolysiloxane such as octamethyldiphenylsiloxane, and cyclic polysiloxane such as octamethylcyclotetrasiloxane and decamethylcyclopentasiloxane. Of these, octamethylcyclotetrasiloxane and decamethylcyclopentasiloxane are preferably usable from the viewpoint of imparting gloss to clothes.

Moreover, examples of the halogen base solvent include tetrachloroethylene; 1,1,2-trichloro-1,2,2-trifluoroethane; 1,1,1-trichloroethane, and alternative solvents to flon such as 1,3-dichloro-1,2,2,3,3-pentafluoropropane and 1,1-dichloro-1-monofluoroethane. Further, examples of the petroleum base solvent include paraffin, isoparaffin, naphthene, xylene and diethylbenzene.

The amount of the silicone base solvent to be added to the detergent composition for dry cleaning according to the present invention is 5 to 1000 times by volume, preferably 50 to 300 times by volume each based on the composition. The amount thereof, when being less than 5 times by volume, brings about a fear of difficulty in improving softness and conformability and an economic disadvantage, whereas the amount thereof, when being more than 1000 times by volume, brings about a fear of incapability of obtaining favorable detergency, capability of preventing recontamination or solubilizing power in water.

In addition, the concentration of the component (a) in the detergent liquid is preferably in the range of 0.05 to 0.3% by weight, and the concentration thereof lower than 0.05% by weight leads to deterioration in detergency, capability of preventing recontamination or solubilizing power in water as the case may be.

Further, the present invention also include a method for cleaning an object to be cleaned by the use of the above-mentioned detergent liquid for dry cleaning. For instance, there is exemplified a method which comprises immersing an object to be cleaned such as contaminated clothes in the detergent liquid according to the present invention, and cleaning the object at a temperature, for instance, in the range of 0 to 40° C.

It is preferable in present invention to carry out an aqueous treatment prior to or after the cleaning by dry cleaning to remove water-soluble dirt. As the aqueous cleaning treatment to be carried out prior to the cleaning by dry cleaning, there is exemplified, for instance, a method which comprises spraying an a treatment agent such as an aqueous detergent comprising ethanol, water and 1 to 50% by weight of a surfactant such as a polyoxyethylene fatty acid ester and polyoxyethylene alkylene ether, centrally onto stain portion of an object to be cleaned, impregnating the detergent thereinto and allowing dirt to swell. In addition as the aqueous cleaning treatment to be carried out after the cleaning by dry cleaning, there is exemplified, for instance, a method which comprises drying the object to be cleaned after dry cleaning, adding the above-mentioned treatment agent in an amount of 1 to 2% by weight based on the object to be cleaned, and effecting wet cleaning for 5 to 15 minutes.

The detergent composition for dry cleaning and detergent liquid for dry cleaning using the composition each according to the present invention are imparted with excellent detergency, capability of preventing recontamination and solubilizing power in water, are less prone to cause annular stain on clothes even when a pretreatment agent is used, impart softness and conformability to an object to be cleaned, and have favorable stability with the lapse of time.

In what follows, the present invention will be described in more detail with reference to working examples.

EXAMPLES 1 TO 14

Fourteen kinds of detergent compositions for dry cleaning were prepared each in a blending proportion (% by weight) as given in Table 1, and evaluations were made of the characteristics of each of the compositions.

{Component (a)}

Nine kinds of nonionic surfactants described hereunder were used as the component (a):

{Component (a-1)} sorbitan monooleate

{Component (a-2)} sorbitan trioleate

{Component (a-3)} polyoxyethylene (3 mol)-polyoxypropylene (6 mol) tridecyl ether {Component (a-4)} polyoxyethylene (4 mol) oleic ester {Component (a-5)} polyoxyethylene (4 mol) sorbitan oleic ester {Component (a-6)} lauric acid diethanolamide {Component (a-7)} adduct of lauric acid diethanolamide with 2 mol of ethylene oxide {Component (a-8)} polyoxyethylene (6 mol) nonylphenyl ether {Component (a-9)} polyoxyethylene (6 mol) octadecenyl ether {Component (b)}

Two kinds of cyclic polysiloxanes described hereunder were used as the component (b):

{Component (b-1)} octamethylcyclotetrasiloxane (k=4)

{Component (b-2)} decamethylcyclopentasiloxane (k=5)

{Component (c)}

Three kinds of polyether modified silicones described hereunder were used as the component (c):

{Component (c-1)} a compound of the general formula (2) having an HLB of 3.5 in which $R^1$, $R^4$ and $R^5$ are each methyl group; in $R^2$ p is 3, q is 4 and r is 0; $R^3$ is hydrogen atom; m is 28; and n is 3

{Component (c-2)} a compound of the general formula (2) having an HLB of 1.2 in which $R^1$, $R^4$ and $R^5$ are each methyl group; in $R^2$ p is 3, q is 0 and r is 8; $R^3$ is butyl group; in is 7; and n is 4

{Component (c-3)} a compound of the general formula (2) having an HLB of 2.1 in which $R^1$ is methyl group; in $R^2$ p is 3, q is 4 and r is 0; $R^3$ is hydrogen atom; $R^4$ and $R^5$ are each $R^2$; m is 40; and n is 0

{Other components}

{Other component 1} dimethyloctadecylhydroxy ammonium paratoluene sulfonate

{Other component 2} dimethyloctadecylhydroxy ammonium nitrate

{Other component 3} undecyl potassium phosphate

{Other component 4} dodecylbenzene calcium sulfonate

{Other component 5} 2-oleyl-hydroxyethylimidazoline ammonium sulfate

TABLE 1

| Blending Proportion (% by weight) | | Example 1 | 2 | 3 | 4 | 5 | 6 | 7 | 8 |
|---|---|---|---|---|---|---|---|---|---|
| Component (a) | a-1 | | 30 | | 27 | | 35 | | |
| | a-2 | | | 25 | | | | 23 | |
| | a-3 | 15 | | | | 45 | | | 36 |
| Component (b) | b-1 | | 55 | | 40 | | 30 | 46 | |
| | b-2 | 60 | | 66 | | 45 | | | 41 |
| Component (c) | c-1 | | | 9 | | | 35 | | 14 |
| | c-2 | 25 | | | | 10 | | | |
| | c-3 | | 15 | | 33 | | | 23 | |
| Other Components | Other comp-1 (component-1) | | | | | | | 8 | |
| | Other comp-2 | | | | | | | | 9 |
| | Other comp-3 | | | | | | | | |
| | Other comp-4 | | | | | | | | |
| Component(b) + Component (c) | | 85 | 70 | 75 | 73 | 55 | 65 | 69 | 55 |
| Component(b)/Component (c) | | 2.4/1 | 3.7/1 | 7.3/1 | 1.2/1 | 4.5/1 | 1/1.2 | 2.0/1 | 2.9/1 |
| Evalution Results | Detergency (%) | 33 | 34 | 32 | 35 | 34 | 33 | 34 | 33 |
| | Recontamination rate (%) | 2 | 2 | 3 | 2 | 2 | 3 | 4 | 3 |
| | Solubilizing power in water | 0.7 | 0.9 | 1 | 0.9 | 0.7 | 1 | 0.9 | 0.7 |
| | Capability of preventing annular stain | ○ | ○ | ○ | ○ | ○ | ○ | ○ | ○ |
| | Softness/conformability (points) | 53 | 52 | 53 | 53 | 52 | 53 | 56 | 57 |
| | Stability with lapse | ○ | ○ | ○ | ○ | ○ | ○ | ○ | ○ |

TABLE 1-continued

| | of time | | | | | | |
|---|---|---|---|---|---|---|---|
| | | Example | | | | | |
| Blending Proportion (% by weight) | | 9 | 10 | 11 | 12 | 13 | 14 |
| Component (a) | a-1 | 19 | | | | 25 | |
| | a-2 | | 27 | | | | |
| | a-3 | | | | | | |
| | a-4 | | | 13 | | | |
| | a-5 | | | 14 | | | |
| | a-6 | | | | 20 | | |
| | a-7 | | | | 25 | | |
| | a-8 | | | | | | 9 |
| | a-9 | | | | | | 10 |
| Component (b) | b-1 | | 45 | 40 | | 30 | |
| | b-2 | 47 | | | 45 | | 47 |
| Component (c) | c-1 | | | | | 35 | |
| | c-2 | 28 | | | 10 | | 28 |
| | c-3 | | 18 | 33 | | | |
| Other Components (comp) | Other comp-1 (component-1) | | | | | | |
| | Other comp-2 | | | | | | |
| | Other comp-3 | 6 | 7 | | | | 6 |
| | Other comp-4 | | 3 | | | | |
| | Other comp-5 | | | | | 10 | |
| Component(b) + Component (c) | | 75 | 63 | 73 | 55 | 65 | 75 |
| Component(b)/Component (c) | | 1.7/1 | 2.5/1 | 1.2/1 | 4.5/1 | 1/1.2 | 1.7/1 |
| Evalution Results | Detergency (%) | 35 | 34 | 35 | 34 | 33 | 35 |
| | Recontamination rate (%) | 2 | 2 | 2 | 2 | 3 | 2 |
| | Solubilizing power in water | 1.2 | 1.4 | 0.9 | 0.7 | 1.0 | 1.1 |
| | Capability of preventing annular stain | ○ | ○ | ○ | ○ | ○ | ○ |
| | Softness/conformability (points) | 54 | 53 | 53 | 52 | 58 | 54 |
| | Stability with lapse of time | ○ | ○ | ○ | ○ | ○ | ○ |

COMPARATIVE EXAMPLES 1 TO 8

In the same manner as in Examples, 8 kinds of detergent compositions for dry cleaning were prepared each in a blending proportion (% by weight) as given in Table 2, and evaluations were made of the characteristics of each of the compositions.

{Component (c)}

Two kinds of polyether modified silicones described hereunder were used as the component (c):

{Component (c-4)} a compound of the general formula (2) having an HLB of 9.8 in which $R^1$, $R^4$ and $R^5$ are each methyl group; in $R^2$ p is 3, q is 12 and r is 0; $R^3$ is hydrogen atom; m is 25; and n is 4

{Component (c-5)} a compound of the general formula (2) having an HLB of 12.7 in which $R^1$ and $R^4$ are each methyl group; in $R^2$ p is 3, q is 34 and r is 0; $R^3$ is hydrogen atom; $R^5$ is $R^2$; m is 9; and n is 0.

TABLE 2

| | | Comparative Example | | | | | | | |
|---|---|---|---|---|---|---|---|---|---|
| Blending Proportion (% by weight) | | 1 | 2 | 3 | 4 | 5 | 6 | 7 | 8 |
| Component (a) | a-1 | | 80 | | 27 | | 35 | | |
| | a-2 | | | 23 | | | | | |
| | a-3 | | | | | 42 | | 15 | 15 |
| Component (b) | b-1 | | 10 | | 70 | | 65 | | |
| | b-2 | 60 | | 5 | | | | 60 | 60 |
| Component (c) | c-1 | | | 65 | | | | | |
| | c-2 | 40 | | | | 51 | | | |
| | c-3 | | 10 | | 3 | | | | |
| | c-4 | | | | | | | 25 | |
| | c-5 | | | | | | | | 25 |
| Other Components | Other comp-1 (component-1) | | | 7 | | | | | |
| | Other comp-2 | | | | | 7 | | | |
| Component (b) + Component (c) | | 100 | 20 | 70 | 73 | 51 | 65 | 85 | 85 |
| Component(b)/Component (c) | | 1.5/1 | 1.0/1 | 1/13 | 23.3/1 | 0 | — | 2.4/1 | 2.4/1 |

TABLE 2-continued

| Blending Proportion (% by weight) | | Comparative Example 1 | 2 | 3 | 4 | 5 | 6 | 7 | 8 |
|---|---|---|---|---|---|---|---|---|---|
| Evalution Results | Detergency (%) | 27 | 35 | 33 | 32 | 33 | 33 | 33 | 32 |
| | Recontamination rate (%) | 9 | 2 | 3 | 4 | 3 | 3 | 3 | 3 |
| | Solubilizing power in water | 0.4 | 1 | 1 | 0.9 | 0.7 | 1 | 0.7 | 0.7 |
| | Capability of preventing annular stain | × | ○ | ○ | ○ | ○ | ○ | ○ | ○ |
| | Softness/conformability (points) | 55 | 53 | 46 | 52 | 47 | 52 | 53 | 52 |
| | Stability with lapse of time | ○ | × | ○ | × | ○ | × | × | × |

Evaluations were made of the characteristics of each of the components in Tables 1 and 2 by the method described hereunder:

(1) Evaluations of detergency and capability of preventing recontamination

In a cup of a Terg-O-tometer was placed 500 milliliter of a detergent solution in which decamethylcyclopentasiloxane (manufactured by GE Toshiba Silicone Co., Ltd. under the trade name "TSF-405") was added in an amount 100 times by volume of a detergent composition, further were placed 2 pieces of contaminated clothes (wool, measuring 10 cm by 10 cm) according to Japan Oil Chemistry Association and 2 pieces of white clothes (wool, measuring 10 cm by 10 cm), and then cleaning was carried out at 30° C., 70 rpm for 20 minutes. The detergency and recontamination rate were obtained by measuring the surface reflectivity of the clothes after drying for light by means of a color computer SM-4 manufactured by Suga Instrument Co., Ltd. and calculating from the following formula:

$$\text{Detergency (\%)}=\{(Y_4-Y_3)/(Y_0-Y_3)\}\times 100$$

$$\text{Recontamination rate (\%)}=\{(Y_0-Y_1)/Y_0\}\times 100$$

wherein $Y_0$ is surface reflectivity of the original white clothes before drying, $Y_1$ is surface reflectivity of the original white clothes after drying, $Y_3$ is surface reflectivity of the contaminated clothes before drying, $Y_4$ is surface reflectivity of the contaminated clothes after drying.

A detergent composition having a detergency of at least 30% was evaluated as that having a favorable detergency. In addition, a detergent composition having a recontamination rate of less than 5% was evaluated as that having a favorable capability of preventing recontamination.

(2) Evaluations of solubilizing power in water

In a test tube were placed 40 milliliter of decamethylcyclopentasiloxane (manufactured by GE Toshiba Silicone Co., Ltd. under the trade name "TSF-405) and 5 milliliter of a detergent composition under stirring and thereafter, 0.5 milliliter of of ion exchange water was added to the resultant mixture with vigorous stirring to confirm the appearance in the test tube. When water therein was not separated, the addition of the ion exchange water and the vigorous stirring were repeated in the same manner as above until water therein was separated, and the point of time when water was separated was regarded as the end point. The solubilizing power in water was obtained by finding the ratio by volume of the solubilizing water (volume of ion exchange water added from the start to the end point) to 5 milliliter of the detergent composition. A detergent composition having a solubilizing power of at least 0.6 was evaluated as that having a favorable solubilizing power in water.

(3) Evaluations of capability of preventing annular stain on clothes

A pretreatment agent (consisting of 10% by weight of polyoxyethylene oleyl ester, 10% by weight of ethanol and 80% by weight of water) in an amount of 1.0 g was added dropwise to polyester white clothes (measuring 10 cm by 10 cm, about 1.4 g) to impregnate the agent into the clothes and immediately thereafter, cleaning was carried out by the method as described in the preceding item (1). The clothes thus cleaned were subjected to air drying at room temperature, and then evaluations were made of capability of preventing annular stain on clothes by marking the case where no annular stain was observed on the polyester white clothes as "O" and the case where annular stain was observed thereon as "X".

(4) Evaluations of softness and conformability

White wool clothes (measuring 20 cm by 20 cm) were cleaned by the method as described in the preceding item (1). The clothes thus cleaned were subjected to air drying at room temperature, and then allowed to stand in an air-conditioned room at 25° C. and 65% RH for 24 hours. Subsequently, functional evaluations were made by 20 women as panels of softness and conformability of samples each composed of three pieces of white wool that had been cleaned, dried and superimposed on one another. Thus, by allowing soft and non-sticky feeling to score 3 points, rather soft feeling to score 2 points, and stiff or sticky feeling to score 1 point, total points were obtained from the 20 women as panels. The detergents which gained total points of 50 or more were evaluated as those having favorable softness and conformability.

(5) Evaluations of stability with the lapse of time

Detergent compositions each in an amount of 80 milliliter were placed in a 100 milliliter glass made vial, and preserved in a thermostat at minus 5° C., 25° C. and 45° C., respectively for a period of one month, and the appearance of each of the compositions was observed to visually judge on the basis of the criterion as described hereunder:

O; the appearance of the composition remains unchanged from that prior to the preservation at any of the above-mentioned temperatures X; the appearance thereof changed from that prior to the preservation, including galation, separation, deposit of precipitate or the like at either of the temperatures As the results, the detergencies of the detergent compositions for dry cleaning in Examples 1 to 14 according to the present invention are in the range of 32 to 35%, and exceed 30% which is regarded as having sufficient detergency. Moreover, the recontamination rates thereof are in the range of 2 to 4%, and are less than 5% which is regarded as having sufficient capability of preventing recontamination. Further, solubilizing powers in water are at least 0.6 which means favorable water holding capacity. In addition, no annular stain was recognized on the clothes tested in the Examples. Furthermore, in the Examples, softness and conformability favorably gained total points of 52 to 58 without any change in the appearance, maintaining favorable stability with the lapse of time. As opposed to the foregoing, the detergent composition not containing the component (a) in Comparative Example 1 is inferior in any of the detergency, capability of preventing recontamination and solubilizing power in water with unfavorable annular stain observed on clothes. Poor stability with the lapse of time was recognized in the detergent composition of Comparative Example 2 which had an unreasonably high blending amount of the component (a), in the detergent composition of Comparative Example 4 which had an unreasonably high ratio by weight of the component (b) to the component (c), in the detergent composition of Comparative Example 6 which was free from the component (c) and in the detergent compositions of Comparative Examples 7 and 8 in which the HLB values exceeded 6. Further, poor softness and conformability were recognized in the detergent composition of Comparative Example 3 which had an unreasonably low ratio by weight of the component (b) to the component (c) and in the detergent composition of Comparative Example 5 which was free from the component (b) even though a cationic surfactant was added in the compositions.

INDUSTRIAL APPLICABILITY

The present invention can be utilized for a detergent composition for dry cleaning which is excellent in detergency, capability of preventing recontamination and solubilizing power in water, which is less prone to cause annular stain on clothes even when a pretreatment agent is used, which imparts favorable flexibility and conformability to an object to be cleaned and which has favorable stability with the lapse of time; and for a detergent liquid for dry cleaning using the aforesaid composition.

The invention claimed is:

1. A detergent composition for dry cleaning, which comprises a nonionic surfactant as component (a), a cyclic polysiloxane represented by the general formula (1) as component (b), a polyether modified silicone having a HLB value of at most 6 and represented by the general formula (2) as component (c), component (c) being different from the component (a), wherein the content of the component (a) is 5 to 70% by weight based on the total weight of the components (a), (b) and (c), the content of the total of the components (b) and (c) is 30 to 95% by weight based on the total weight of the components (a), (b) and (c), and the ratio by weight of the component (b) to the component (c) is 1/10 to 10/1, from 0.1 to 15% by weight of at least one species selected from the group consisting of an alkylimidazoline cationic surfactant or an alkyldimethylhydroxyethyl ammonium salt cationic surfactant as component (d), and a dry cleaning solvent selected from the group consisting of a halogen based solvent, a petroleum based solvent, or a silicone based solvent, said silicone based solvent being a different compound from said cyclic polysiloxane as component (e), wherein component (e) is present in an amount of 5 to 1000 times by volume, based on the total weight of components (a), (b), (c), and (d):

(1)

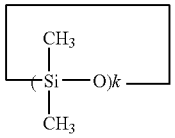

wherein k is a number from 3 to 6, (2)

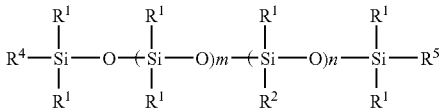

wherein $R^1$ is an alkyl group having 1 to 5 carbon atoms or a phenyl group; $R^2$ is —$(CH_2)p$—O—$(C_2H_4O)q$ $(C_3H_6O)r$—$R^3$ ($R^3$ is hydrogen atom or an alkyl group having 1 to 5 carbon atoms, p is a number from 1 to 5, q and r are each the average number of addition moles, q is a number from 0 to 50, r is a number from 0 to 30 with the proviso that $1 \leqq q+r<60$); m and n are each an average degree of polymerization, m is a number from 1 to 300, n is a number from 0 to 50; $R^4$ and $R^5$ are each an alkyl group having 1 to 5 carbon atoms or phenyl group or $R^2$, and may be the same as or different from each other with the proviso that when n is equal to 0, at least one of $R^4$ and $R^5$ is $R^2$.

2. A detergent composition for dry cleaning, which comprises a nonionic surfactant as component (a), a cyclic polysiloxane represented by the general formula (1) as component (b), a polyether modified silicone having a HLB value of at most 6 and represented by the general formula (2) as component (c), component (c) being different from the component (a), wherein the content of the component (a) is 5 to 70% by weight based on the total weight of the components (a), (b) and (c), the content of the total of the components (b) and (c) is 30 to 95% by weight based on the total weight of the components (a), (b) and (c), and the ratio by weight of the component (b) to the component (c) is 1/10 to 10/1, from 0.1 to 15% by weight of at least one species selected from the group consisting of an alkylphosphoric ester anionic surfactant or an alkylbenzene sulfonate anionic surfactant as component (d), and a dry cleaning solvent selected from the group consisting of a halogen based solvent, a petroleum based solvent, or a silicone based solvent, said silicone based solvent being a different compound from said cyclic polysiloxane as component (e), wherein component (e) is present in an amount of 5 to 1000 times by volume, based on the total weight of components (a), (b), (c), and (d):

(1)

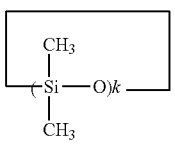

wherein k is a number from 3 to 6, (2)

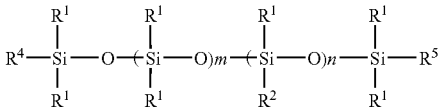

wherein $R^1$ is an alkyl group having 1 to 5 carbon atoms or a phenyl group; $R^2$ is —$(CH_2)p$ —O—$(C_2H_4O)q(C_3H_6O)r$ —$R^3$ ($R^3$ is hydrogen atom or an alkyl group having 1 to 5 carbon atoms, p is a number from 1 to 5, q and r are each the average number of addition moles, q is u ber from 0 to 50, r is a number from 0 to 30 with the proviso that $1 \leqq q+r<60$); m and n are each an average degree of polymerization, m is a number from 1 to 300, n is a number from 0 to 50; $R^4$ and $R^5$ are each an alkyl group having 1 to 5 carbon atoms or phenyl group or $R^2$, and may be the same as or different from each other with the proviso that when n is equal to 0, at least one of $R^4$ and $R^5$ is $R^2$.

3. A detergent composition for dry cleaning as set forth in claim 1 wherein said dry cleaning solvent is a silicone based solvent.

4. A detergent composition for dry cleaning as set forth in claim 2 wherein said dry cleaning solvent is a silicone based solvent.

5. A cleaning method comprising cleaning a material to be dry cleaned using the detergent composition for dry cleaning as set forth in claim 1.

6. The cleaning method according to claim 5, wherein at the time of cleaning by using the detergent composition, a pretreatment is performed prior to said cleaning or a post-treatment is performed after said cleaning each by the use of an aqueous treatment agent.

7. A cleaning method comprising cleaning a material to be dry cleaned using the detergent composition for dry cleaning as set forth in claim 2.

8. The cleaning method according to claim 7, wherein at the time of cleaning by using the detergent composition, a pretreatment is performed prior to said cleaning or a post-treatment is performed after said cleaning each by the use of an aqueous treatment agent.

9. The detergent composition for dry cleaning according to claim 1, which includes the component (a) in an amount in the range of 0.05 to 0.3% by weight.

10. The detergent composition for dry cleaning according to claim 2, which includes the component (a) in an amount in the range of 0.05 to 0.3% by weight.

* * * * *